US007911418B2

(12) United States Patent
Yoshihama et al.

(10) Patent No.: US 7,911,418 B2
(45) Date of Patent: Mar. 22, 2011

(54) METHOD OF DRIVING PLASMA DISPLAY PANEL, AND PLASMA DISPLAY DEVICE

(75) Inventors: Yutaka Yoshihama, Osaka (JP); Shigeo Kigo, Osaka (JP)

(73) Assignee: Panasonic Corporation, Osaka (JP)

( * ) Notice: Subject to any disclaimer, the term of this patent is extended or adjusted under 35 U.S.C. 154(b) by 210 days.

(21) Appl. No.: 12/295,802

(22) PCT Filed: Nov. 8, 2007

(86) PCT No.: PCT/JP2007/071683

§ 371 (c)(1), (2), (4) Date: Oct. 2, 2008

(87) PCT Pub. No.: WO2008/059745

PCT Pub. Date: May 22, 2008

(65) Prior Publication Data

US 2009/0096719 A1 Apr. 16, 2009

(30) Foreign Application Priority Data

Nov. 14, 2006 (JP) ..... 2006-307433

(51) Int. Cl.
*G09G 3/28* (2006.01)

(52) U.S. Cl. ..... 345/66; 345/63; 345/67

(58) Field of Classification Search ..... 345/60–73
See application file for complete search history.

(56) References Cited

U.S. PATENT DOCUMENTS

| | | | | |
|---|---|---|---|---|
| 6,404,411 | B1 * | 6/2002 | Masuda et al. | 345/66 |
| 2004/0113871 | A1 * | 6/2004 | Kashio et al. | 345/63 |
| 2008/0048937 | A1 | 2/2008 | Ogawa et al. | |

FOREIGN PATENT DOCUMENTS

| | | |
|---|---|---|
| JP | 2000-242224(A) | 9/2000 |
| JP | 2001-255847(A) | 9/2001 |
| JP | 2002-082648(A) | 3/2002 |

(Continued)

OTHER PUBLICATIONS

International Search Report for PCT/JP2007/071683 dated Dec. 11, 2007.

(Continued)

*Primary Examiner* — Richard Hjerpe
*Assistant Examiner* — Olga Merkoulova
(74) *Attorney, Agent, or Firm* — RatnerPrestia

(57) ABSTRACT

A method and device for driving a plasma display panel are provided that do not cause false lighting even if the all-cell initializing operation becomes unstable. In an initializing period of a subfield, an all-cell initializing operation of causing initializing discharge in all discharge cells or a selective initializing operation of causing initializing discharge in the discharge cell that has caused sustain discharge in the last sustain period is performed. In a field corresponding to an image signal for displaying black on the whole screen, an abnormal charge erasing period for applying rectangular waveform voltage to the scan electrode is disposed after the initializing period in the subfield where the all-cell initializing operation is firstly performed. In a field corresponding to an image signal other than the image signal for displaying black on the whole screen, an abnormal charge erasing period for applying rectangular waveform voltage to the scan electrode is disposed after the initializing period in any subfield after the subfield where the all-cell initializing operation is firstly performed.

8 Claims, 10 Drawing Sheets

FOREIGN PATENT DOCUMENTS

| | | |
|---|---|---|
| JP | 2004-109838(A) | 4/2004 |
| JP | 2004-191530(A) | 7/2004 |
| JP | 2004-326068(A) | 11/2004 |
| JP | 2005-301259(A) | 10/2005 |
| JP | 2005-326612(A) | 11/2005 |
| JP | 2006-308626(A) | 11/2006 |
| JP | 2007/099891(A1) | 9/2007 |
| WO | WO 2005/111974 A1 | 11/2005 |

OTHER PUBLICATIONS

Supplementary European Search Report for EP 07 83 1414, Feb. 9, 2009.

* cited by examiner

METHOD OF DRIVING PLASMA DISPLAY PANEL, AND PLASMA DISPLAY DEVICE

This Application is a U.S. National Phase Application of PCT International Application PCT/JP2007/071683.

TECHNICAL FIELD

The present invention relates to a driving method of a plasma display panel used in a wall-hanging television (TV) or a large monitor, and a plasma display device.

BACKGROUND ART

A typical AC surface discharge type panel used as a plasma display panel (hereinafter referred to as "panel") has many discharge cells between a front plate and a back plate that are faced to each other.

The front plate has the following elements:

- a plurality of display electrode pairs disposed in parallel on a front substrate; and
- a dielectric layer and a protective layer for covering the display electrode pairs.

Here, each display electrode pair is formed of a pair of scan electrode and sustain electrode. The back plate has the following elements:

- a plurality of data electrodes disposed in parallel on a back substrate;
- a dielectric layer for covering the data electrodes;
- a plurality of barrier ribs disposed on the dielectric layer in parallel with the data electrodes; and phosphor layers disposed on the surface of the dielectric layer and on side surfaces of the barrier ribs.

The front plate and back plate are faced to each other so that the display electrode pairs and the data electrodes three-dimensionally intersect, and are sealed. Discharge gas containing xenon at a partial pressure of 5%, for example, is filled into a discharge space. Discharge cells are disposed in intersecting parts of the display electrode pairs and the data electrodes. In the panel having this structure, ultraviolet rays are emitted by gas discharge in each discharge cell. The ultraviolet rays excite respective phosphors of red, green, and blue to emit light, and thus provide color display.

A subfield method is generally used as a method of driving the panel. In this method, one field period is divided into a plurality of subfields, and the subfields at which light is emitted are combined, thereby performing gradation display.

Each subfield has an initializing period, an address period, and a sustain period. In the initializing period, initializing discharge is performed to form a wall charge required for a subsequent addressing operation on each electrode. The initializing operation includes an initializing operation (hereinafter referred to as "all-cell initializing operation") of causing initializing discharge in all discharge cells, and an initializing operation (hereinafter referred to as "selective initializing operation") of selectively causing initializing discharge in a discharge cell having performed sustain discharge in the sustain period of the last subfield.

In the address period, address discharge is selectively performed to form a wall charge in a discharge cell where display is to be performed. In the sustain period, sustain pulses are alternately applied to the display electrode pairs formed of the scan electrodes and the sustain electrodes, sustain discharge is caused in the discharge cell having performed address discharge, and a phosphor layer of the corresponding discharge cell is light-emitted, thereby displaying an image.

Of the subfield method, a panel driving method is proposed. In this driving method, the contrast can be kept sharp by reducing the background luminance, and the dynamic false contour can be reduced by suppressing the variation in brightness of picture. This method is disclosed in patent document 1, for example.

Of the subfield method, a new driving method is disclosed. In this driving method, the initializing discharge is performed using a gently varying ramp waveform voltage, and the initializing discharge is selectively applied to the discharge cell having performed sustain discharge. Thus, light emission that is not related to the gradation display is minimized, and the contrast ratio is improved.

Specifically, in the initializing period of one of a plurality of subfields, the all-cell initializing operation of causing discharge from all discharge cells is performed. In the initializing period of another subfield, the selective initializing operation of initializing only the discharge cell having performed sustain discharge in the sustain period of the last subfield is performed. As a result, light emission that is not related to the display is only the light emission accompanying the discharge of the all-cell initializing operation, and an image having high contrast can be displayed. This driving method is disclosed in patent document 2, for example.

In a panel where the partial pressure of xenon is increased to improve the light emitting efficiency, the initializing discharge becomes unstable, and a address failure can occur in the subsequent address period. A driving method of the panel where high-quality image is displayed by stabilizing the initializing discharge is proposed. The driving method is disclosed in patent document 3, for example.

Recently, while the improvement of image display quality has been demanded, factors destabilizing the discharge have been increased by enlargement of the panel, refining of the discharge cell, or increase in the xenon partial pressure. If the above-mentioned all-cell initializing operation becomes unstable dependently on the display image and a malfunction (hereinafter referred to as "false lighting") for causing sustain discharge in the discharge cell that has not caused address discharge occurs, the image display quality can be reduced significantly.

[Patent document 1] Japanese Patent Unexamined Publication No. 2001-255847

[Patent document 2] Japanese Patent Unexamined Publication No. 2000-242224

[Patent document 3] Japanese Patent Unexamined Publication No. 2005-326612

SUMMARY OF THE INVENTION

The driving method of a plasma display panel of the present invention is a driving method of a plasma display panel having a plurality of discharge cells including a display electrode pair that is formed of a scan electrode and a sustain electrode. The driving method having the following steps:

- providing one field with a plurality of subfields, each of the subfields having an initializing period, an address period, and a sustain period;
- performing, in the initializing period of each subfield, an all-cell initializing operation of causing initializing discharge in all discharge cells or a selective initializing operation of causing initializing discharge in a discharge cell that has caused sustain discharge in the last sustain period;
- providing an abnormal charge erasing period when voltage is applied to a scan electrode after the initializing period in the subfield where the all-cell initializing operation is firstly performed, in the field corresponding to an image signal for displaying black on the whole screen; and providing an abnormal charge erasing period when voltage is applied to a scan electrode after the initializing period in any subfield after the subfield where the all-cell initializing operation is firstly performed, in the field corresponding to an image signal other than the image signal for displaying black on the whole screen.

A plasma display device of the present invention has the following elements:

a plasma display panel having a plurality of discharge cells including a display electrode pair that is formed of a scan electrode and a sustain electrode; and a driving circuit for providing one field period with a plurality of subfields and driving the plasma display panel.

Here, each of the subfields has the following periods:

an initializing period for causing initializing discharge in the discharge cell;

an address period for performing an addressing operation in the discharge cell; and a sustain period for causing sustain discharge in the discharge cell where address discharge is caused by the addressing operation.

The driving circuit performs the all-cell initializing operation of causing the initializing operation in all discharge cells for performing image display, in the initializing period of at least one subfield. The driving circuit applies voltage for erasing abnormal charge to a scan electrode after the initializing period in the subfield where the all-cell initializing operation is firstly performed, in the field corresponding to the image signal for displaying black on the whole screen. The driving circuit applies voltage for erasing abnormal charge to a scan electrode after the initializing period in any subfield after the subfield where the all-cell initializing operation is firstly performed, in the field corresponding to an image signal other than the image signal for displaying black on the whole screen.

REFERENCE MARKS IN THE DRAWINGS

Figure 1:
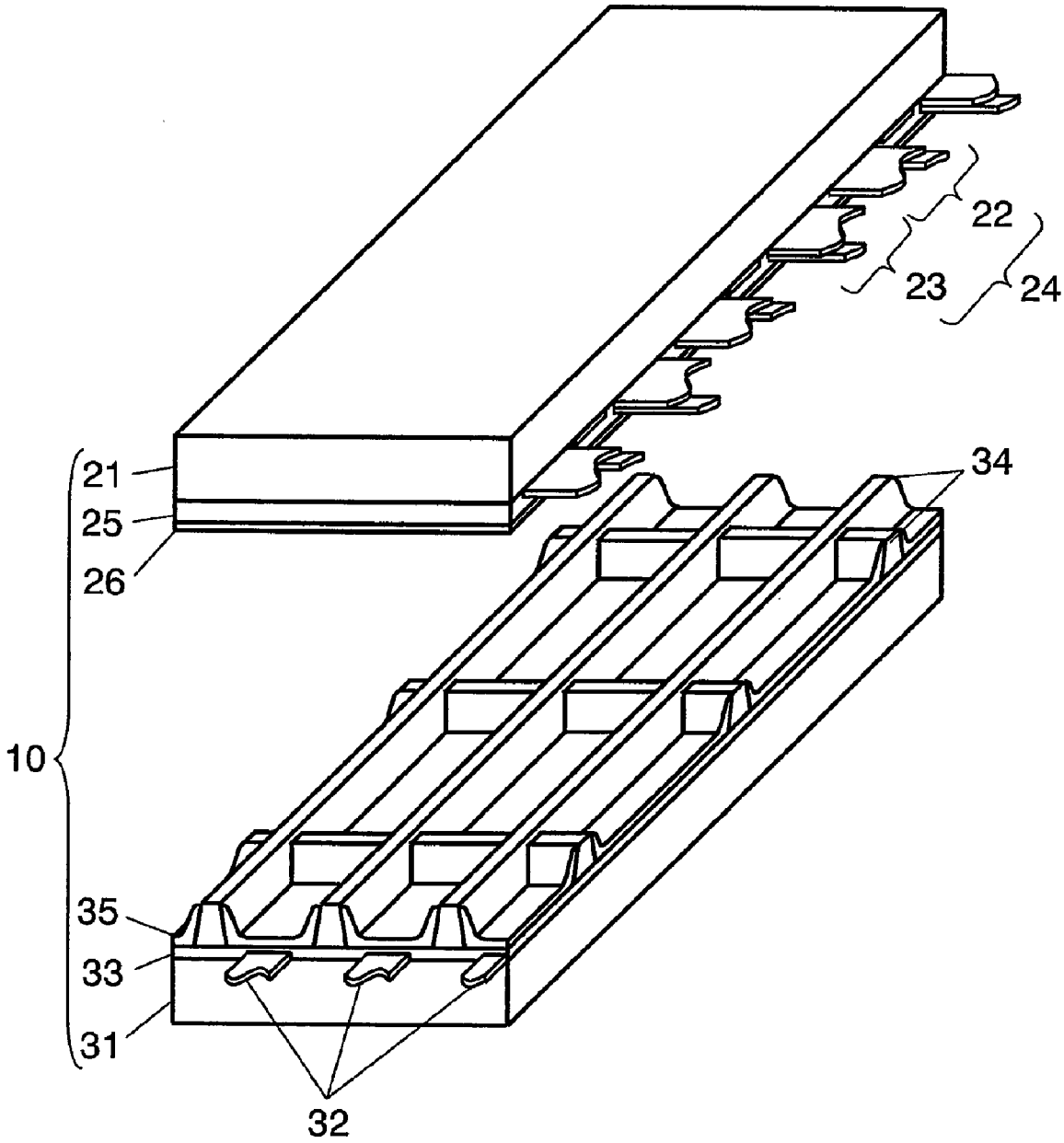
FIG. 1 is an exploded perspective view showing a structure of a panel in accordance with an exemplary embodiment of the present invention.

10 panel
21 front substrate
22 scan electrode
23 sustain electrode
24 display electrode pair
31 back substrate
32 data electrode
51 image signal processing circuit
52 data electrode driving circuit
53 scan electrode driving circuit
54 sustain electrode driving circuit
55 timing generating circuit
61 black display detecting circuit
81 sustain pulse generating circuit
84 initializing waveform generating circuit
88 scan pulse generating circuit
100 plasma display device

DETAILED DESCRIPTION OF PREFERRED EMBODIMENTS

A driving method of a panel and a plasma display device in accordance with an exemplary embodiment of the present invention will be described hereinafter with reference to the accompanying drawings.

Exemplary Embodiment

FIG. 1 is an exploded perspective view showing a structure of panel 10 in accordance with the exemplary embodiment of the present invention. A plurality of display electrode pairs 24 formed of scan electrodes 22 and sustain electrodes 23 are disposed on glass-made front substrate 21. Dielectric layer 25 is formed so as to cover scan electrodes 22 and sustain electrodes 23, and protective layer 26 is formed on dielectric layer 25. A plurality of data electrodes 32 are formed on back substrate 31. Dielectric layer 33 is formed so as to cover data electrodes 32, and mesh-like barrier ribs 34 are formed on dielectric layer 33. Phosphor layers 35 for emitting lights of respective colors of red, green, and blue are formed on the side surfaces of barrier ribs 34 and on dielectric layer 33.

Front substrate 21 and back substrate 31 are faced to each other so that display electrode pairs 24 cross data electrodes 32 with a fine discharge space sandwiched between them, and the outer peripheries of them are sealed by a sealing material such as glass frit. The discharge space is filled with discharge gas containing xenon at a partial pressure ratio of 10%. The discharge space is partitioned into a plurality of sections by barrier ribs 34. Discharge cells are formed in the intersecting parts of display electrode pairs 24 and data electrodes 32. The discharge cells discharge and emit light to display an image.

The structure of panel 10 is not limited to the above-mentioned one, but may be a structure having striped barrier ribs, for example.

Figure 2:
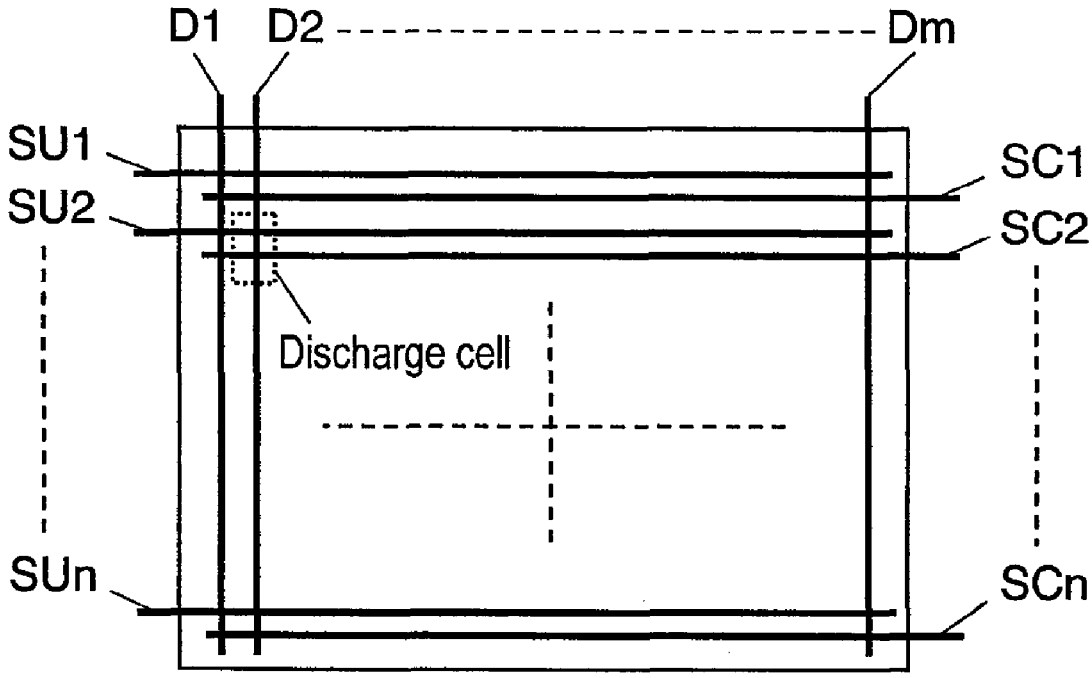
FIG. 2 is an electrode array diagram of the panel.

FIG. 2 is an electrode array diagram of panel 10 in accordance with the exemplary embodiment of the present invention. In panel 10, n scan electrodes SC1 through SCn (scan electrodes 22 in FIG. 1) and n sustain electrodes SU1 through SUn (sustain electrodes 23 in FIG. 1) long in the column direction are arranged, and m data electrodes D1 through Dm (data electrodes 32 in FIG. 1) long in the row direction are arranged. Discharge cells are formed in the intersecting parts of a pair of scan electrode SC1 (i=1 through n) and sustain electrode SU1 and one data electrode Dj (j=1 through m), and the number of formed discharge cells in the discharge space is m×n.

Next, a driving voltage waveform and its operation for driving panel 10 are described. Panel 10 performs gradation display by a subfield method. In this method, one field period is divided into a plurality of subfields, and emission and non-emission of light of each display cell are controlled every subfield. Each subfield has an initializing period, an address period, and a sustain period. In the present embodiment, an abnormal charge erasing period is disposed as necessary between the initializing period and the address period In the initializing period, initializing discharge is performed to form a wall charge required for a subsequent address discharge on each electrode. The initializing operation at this time includes an all-cell initializing operation and a selective initializing operation. In the abnormal charge erasing period, if the initializing operation in the previous all-cell initializing period becomes unstable and abnormal charge is accumulated in any discharge cell, the abnormal charge in the discharge cell is erased. In the address period, address discharge is selectively caused in a discharge cell to emit light, thereby forming a wall charge. In the sustain period, as many sustain pulses as the number proportional to luminance weight are alternately applied to display electrode pairs 24, sustain discharge is caused in the discharge cell having caused address discharge, thereby lighting up or emitting light. The subfield having the initializing period when the all-cell initializing operation is performed is called an all-cell initializing subfield, and the subfield having the initializing period when the selective initializing operation is performed is called a selective initializing subfield.

The detail of the subfield structure will be described later, and the detail and operation of the driving voltage waveform of a subfield are described.

Figure 3:
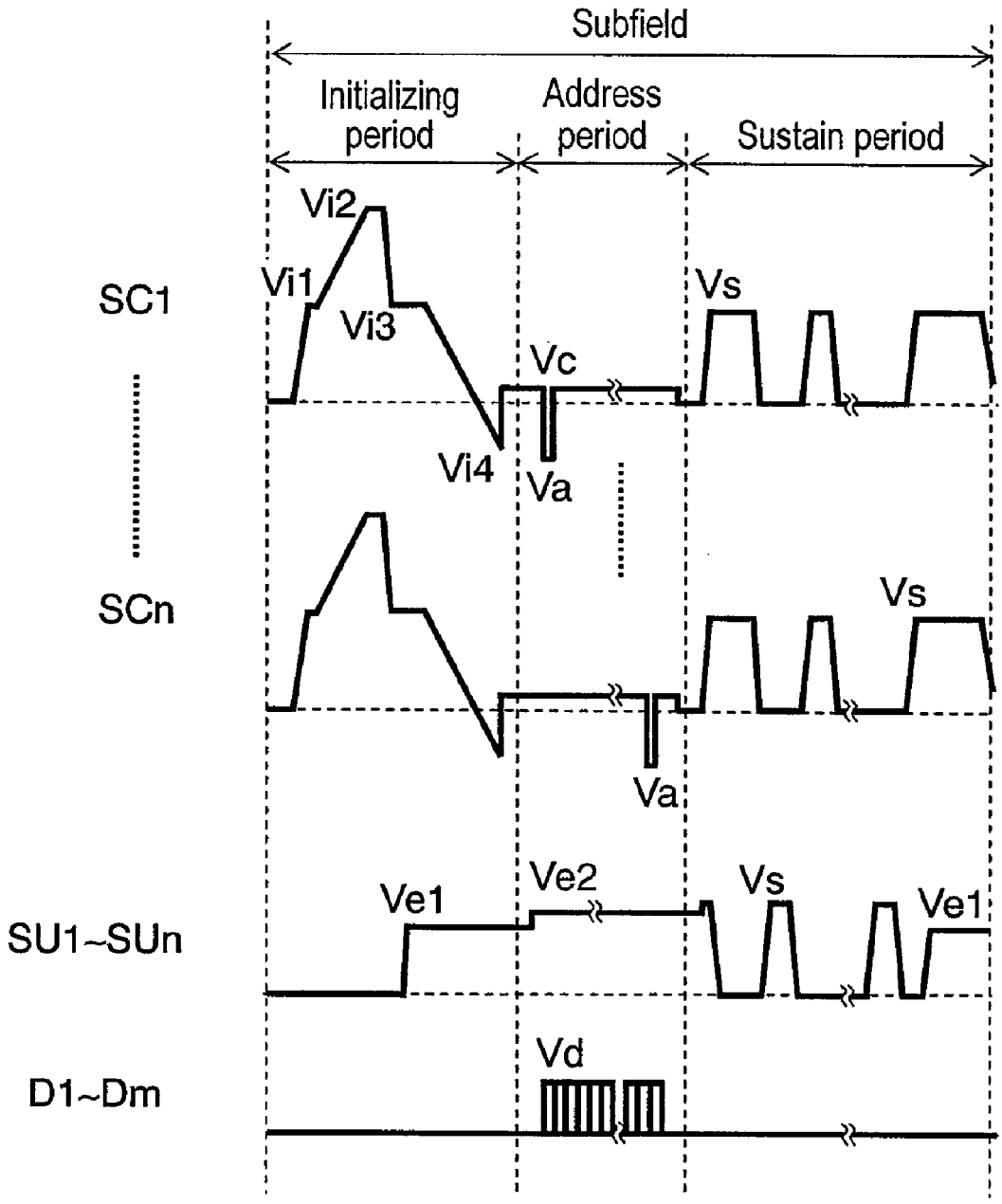
FIG. 3 is a detailed waveform chart of driving voltage of a subfield (that is an all-cell initializing subfield and has no abnormal charge erasing period) in accordance with the exemplary embodiment.
Figure 4:
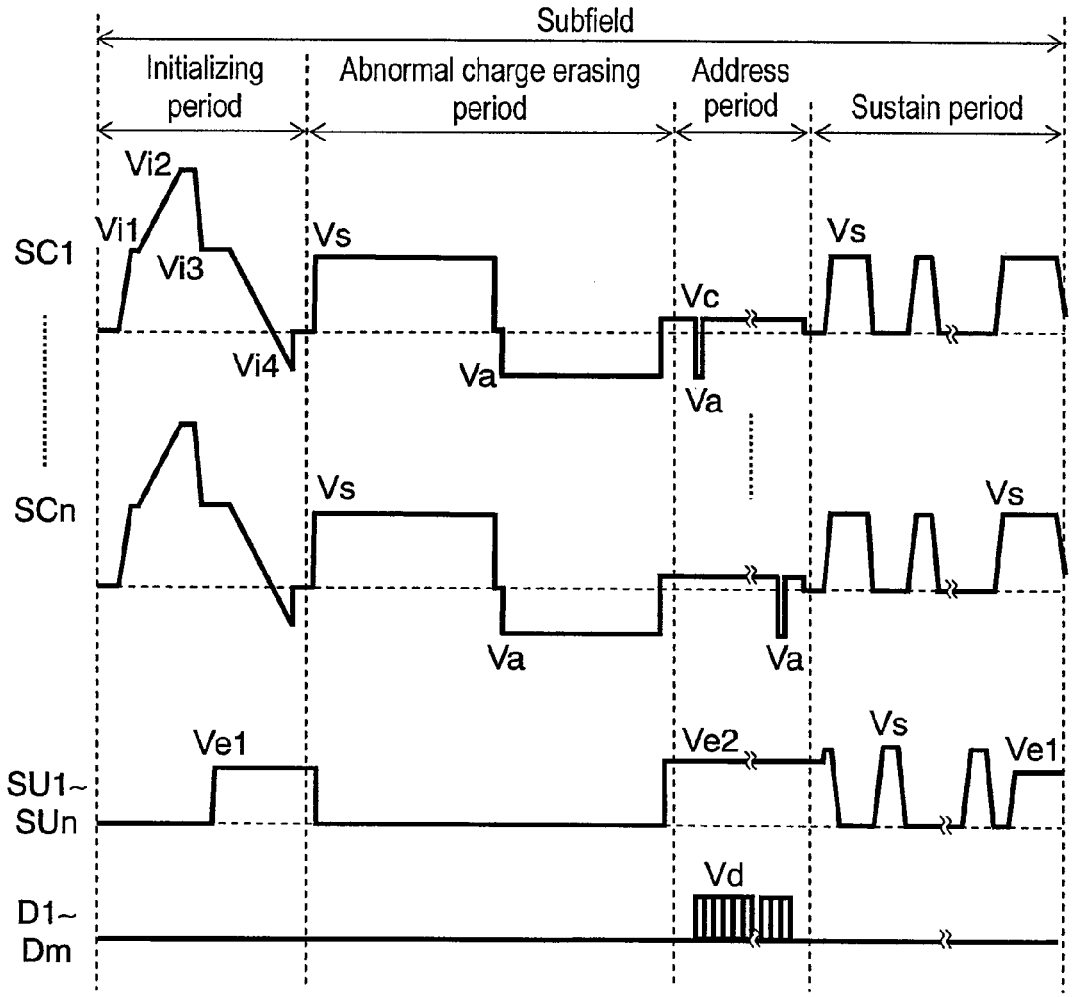
FIG. 4 is a detailed waveform chart of driving voltage of the subfield (that is an all-cell initializing subfield and has an abnormal charge erasing period).
Figure 5:
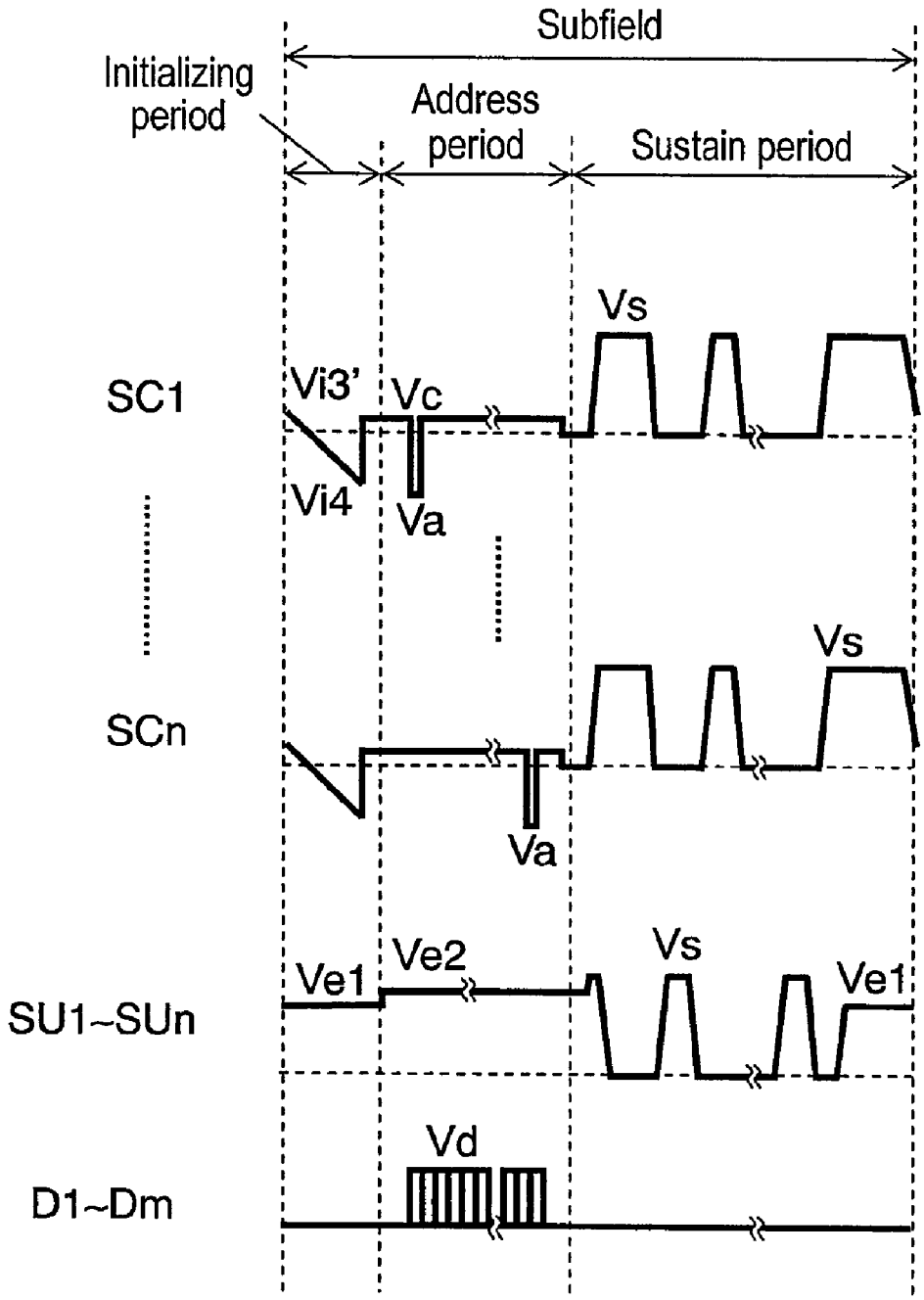
FIG. 5 is a detailed waveform chart of driving voltage of the subfield (that is a selective initializing subfield and has no abnormal charge erasing period).
Figure 6:
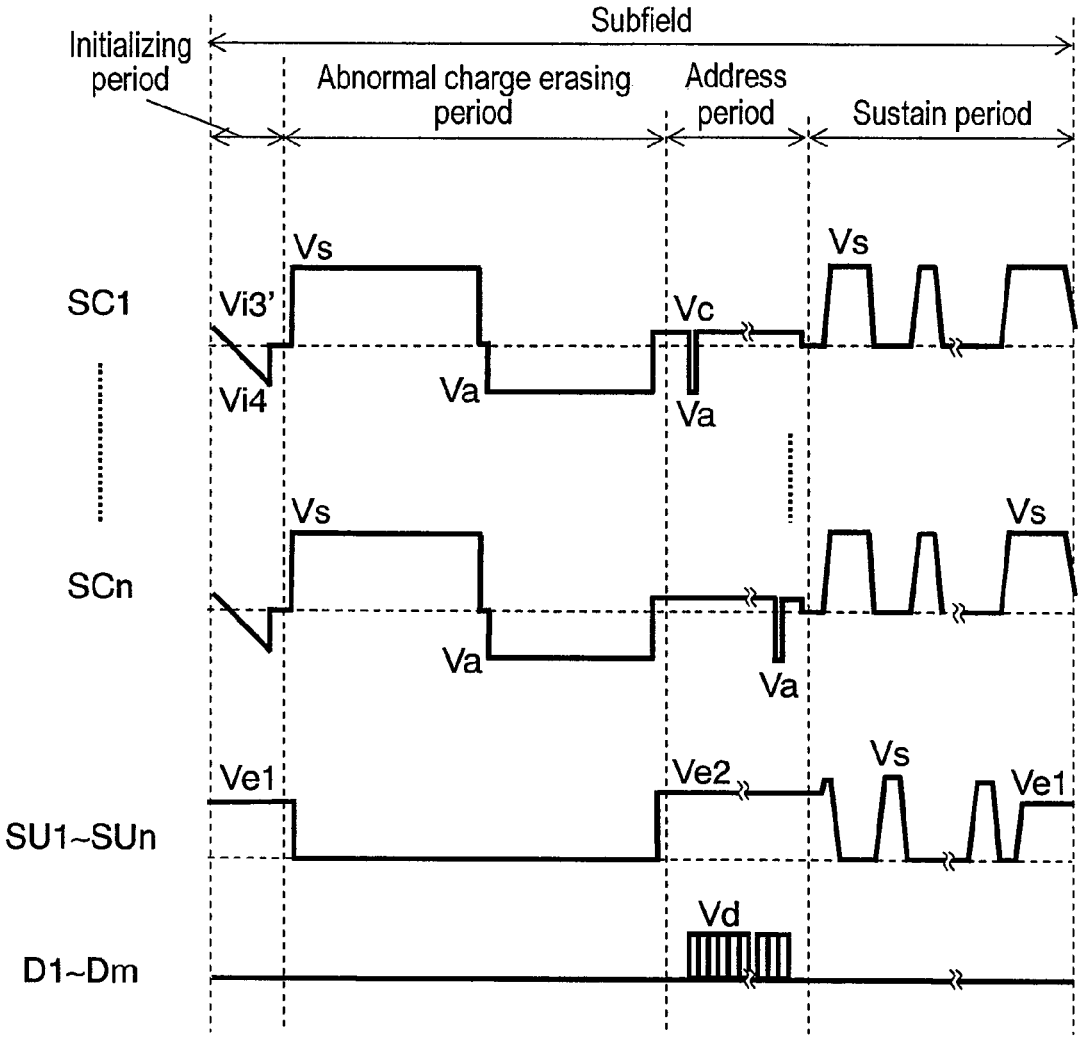
FIG. 6 is a detailed waveform chart of driving voltage of the subfield (that is a selective initializing subfield and has an abnormal charge erasing period).

FIG. 3 through FIG. 6 are detailed waveform charts of driving voltage of a subfield in accordance with the exemplary embodiment of the invention. FIG. 3 shows a detail of the driving voltage waveform of a subfield that is an all-cell initializing subfield and has no abnormal charge erasing period. FIG. 4 shows a detail of the driving voltage waveform of a subfield that is an all-cell initializing subfield and has an abnormal charge erasing period. FIG. 5 shows a detail of the driving voltage waveform of a subfield that is a selective initializing subfield and has no abnormal charge erasing period. FIG. 6 shows a detail of the driving voltage waveform of a subfield that is a selective initializing subfield and has an abnormal charge erasing period.

The driving voltage waveform of the subfield that is an all-cell initializing subfield and has no abnormal charge erasing period is described with reference to FIG. 3.

In the first half of the all-cell initializing period, 0 (V) is applied to data electrodes D1 through Dm and sustain electrodes SU1 through SUn, and a ramp waveform voltage is applied to scan electrodes SC1 through SCn. Here, the ramp waveform voltage gradually increases from voltage Vi1 that is not higher than a breakdown voltage to sustain electrodes SU1 through SUn to voltage Vi2 that is higher than the breakdown voltage.

While the ramp waveform voltage increases, feeble initializing discharge occurs between scan electrodes SC1 through SCn and sustain electrodes SU1 through SUn, and feeble initializing discharge occurs between scan electrodes SC1 through SCn and data electrodes D1 through Dm. Negative wall voltage is accumulated on scan electrodes SC1 through SCn, and positive wall voltage is accumulated on data electrodes D1 through Dm and sustain electrodes SU1 through SUn. Here, the wall voltage on the electrodes means the voltage generated by the wall charges accumulated on the dielectric layer covering the electrodes, the protective layer, and the phosphor layer.

In the last half of the initializing period, positive voltage Ve1 is applied to sustain electrodes SU1 through SUn. A ramp waveform voltage is applied to scan electrodes SC1 through SCn. Here, the ramp waveform voltage gradually decreases from voltage Vi3 that is not higher than the breakdown voltage to sustain electrodes SU1 through SUn to voltage Vi4 that is higher than the breakdown voltage. While the ramp waveform voltage decreases, feeble initializing discharge occurs between scan electrodes SC1 through SCn and sustain electrodes SU1 through SUn, and feeble initializing discharge occurs between scan electrodes SC1 through SCn and data electrodes D1 through Dm. The negative wall voltage on scan electrodes SC1 through SCn and the positive wall voltage on sustain electrodes SU1 through SUn are reduced, positive wall voltage on data electrodes D1 through Dm is adjusted to a value suitable for the addressing operation. Thus, the all-cell initializing operation of applying initializing discharge to all discharge cells is completed.

The case where the all-cell initializing operation is normally performed has been described. When the discharge is destabilized by increase or the like of discharge delay, though the gradually varying ramp waveform voltage is applied, strong discharge can occur between scan electrodes SC1 through SCn and data electrodes D1 through Dm or between scan electrodes SC1 through SCn and sustain electrodes SU1 through SUn. This strong discharge is hereinafter referred to as "abnormal initialing discharge".

The abnormal initialing discharge is apt to occur in a discharge cell that hardly generates the sustain discharge, namely a discharge cell for displaying "black". When the abnormal initialing discharge occurs in the last half of the all-cell initializing period, positive wall voltage is accumulated on scan electrodes SC1 through SCn, negative wall voltage is accumulated on sustain-electrodes SU1 through SUn, and some wall voltage is also accumulated on data electrodes D1 through Dm. When the abnormal initialing discharge occurs in the first half of the all-cell initializing period, the abnormal initialing discharge occurs again in the last half of the all-cell initializing period, and hence the wall voltages are accumulated. These wall voltages disturb the normal operation, so that the wall charge that generates the wall voltages is hereinafter referred to as "abnormal charge".

In the subsequent address period, voltage Ve2 is applied to sustain electrodes SU1 through SUn, and voltage Vc is applied to scan electrodes SC1 through SCn.

Next, negative scan pulse voltage Va is applied to scan electrode SC1 in the first column, positive writing pulse voltage Vd is applied to data electrode Dk (k is 1 through m), of data electrodes D1 through Dm, in the discharge cell to be made to light up in the first column. The voltage difference in the intersecting part of data electrode Dk and scan electrode SC1 is derived by adding the difference between the wall voltage on data electrode Dk and that on scan electrode SC1 to the difference (Vd−Va) of the external applied voltage, and exceeds the breakdown voltage. Address discharge occurs between data electrode Dk and scan electrode SC1 and between sustain electrode SU1 and scan electrode SC1. Positive wall voltage is accumulated on scan electrode SC1, negative wall voltage is accumulated on sustain electrode SU1, and negative wall voltage is also accumulated on data electrode Dk.

Thus, an addressing operation is performed that causes address discharge in the discharge cell to be made to light up in the first column and accumulates wall voltage on each electrode. The voltage in the intersecting parts of scan electrode SC1 and data electrodes D1 through Dm to which writing pulse voltage Vd is not applied does not exceed the breakdown voltage, so that address discharge does not occur. This addressing operation is repeated up to the discharge cell in the n-th column, and the address period is completed.

The discharge cell having abnormal charge does not have wall voltage required for address discharge, so that normal address discharge does not occur.

In the subsequent sustain period, positive sustain pulse voltage Vs is firstly applied to scan electrodes SC1 through SCn, and 0 (V) is applied to sustain electrodes SU1 through SUn. In the discharge cell having caused the address discharge, the voltage difference between scan electrode SC1 and sustain electrode SU1 is obtained by adding the difference between the wall voltage on scan electrode SC1 and that on sustain electrode SU1 to sustain pulse voltage Vs, and exceeds the breakdown voltage.

Sustain discharge occurs between scan electrode SC1 and sustain electrode SU1, and ultraviolet rays generated at this time causes phosphor layer 35 to emit light. Negative wall voltage is accumulated on scan electrode SC1, and positive wall voltage is accumulated on sustain electrode SU1. Positive wall voltage is also accumulated on data electrode Dk. In the discharge cell where address discharge has not occurred in the address period, sustain discharge does not occur, and the wall voltage at the completion of the initializing period is kept.

Subsequently, 0 (V) is applied to scan electrodes SC1 through SCn, and sustain pulse voltage Vs is applied to sustain electrodes SU1 through SUn. In the discharge cell having caused the sustain discharge, the voltage difference between sustain electrode SU1 and scan electrode SC1 exceeds the breakdown voltage. Therefore, sustain discharge occurs between sustain electrode SU1 and scan electrode SC1 again, negative wall voltage is accumulated on sustain electrode SU1, and positive wall voltage is accumulated on scan electrode SC1. Hereinafter, similarly, as many sustain pulses as the number derived by multiplying the luminance weight by luminance magnification are alternately applied to scan electrodes SC1 through SCn and sustain electrodes SU1 through SUn, and potential difference is caused between the electrodes of the display electrode pairs 24. Thus, sustain discharge in the discharge cell that has caused the address discharge in the address period occurs continuously, and the discharge cell to be made to light up comes on.

At the end of the sustain period, so called narrow pulse-like voltage difference is applied between scan electrodes SC1 through SCn and sustain electrodes SU1 through SUn, and the wall voltage on scan electrode SC1 and sustain electrode SU1 is erased in the state where positive wall voltage is kept on data electrode Dk.

Since positive wall voltage is accumulated on the scan electrode of the discharge cell having abnormal charge, and negative wall voltage is accumulated on the sustain electrode of the discharge cell, sustain discharge can occur to cause false lighting in the sustain period. However, the abnormal charge is too small to certainly generate sustain discharge, so that false lighting accidentally occurs. When false lighting does not occur in the sustain period of the first subfield, false lighting can occur in the sustain period of the next subfield. Thus, the discharge cell having abnormal charge can discharge whenever sustain voltage Vs is applied to one electrode of display electrode pair 24. Once false lighting occurs in the sustain period, however, initializing operation is performed normally in the subsequent initializing period. Therefore, normal operation is performed in the subsequent subfield.

Next, the driving voltage waveform of the subfield that is an all-cell initializing subfield and has an abnormal charge erasing period is described with reference to FIG. 4.

The driving voltage waveform in the first half and last half of the all-cell initializing period is the same as that in FIG. 3, and hence it is not described. When the discharge becomes unstable and abnormal initialing discharge occurs, abnormal charge is accumulated that causes positive wall voltage on scan electrodes SC1 through SCn, causes negative wall voltage on sustain electrodes SU1 through SUn, and also causes some wall voltage on data electrodes D1 through Dm.

In the abnormal charge erasing period, while data electrodes D1 through Dm are kept at 0 (V), voltage Vs is applied to scan electrodes SC1 through SCn and 0 (V) is applied to the sustain electrodes. Voltage applied to each electrode at this time is the same as that when sustain pulse voltage Vs is firstly applied to scan electrodes SC1 through SCn in the sustain period.

The abnormal charge erasing period is provided just after the initialing period and before the address period, so that discharge does not occur in a normal discharge cell in the abnormal charge erasing period. Since sustain voltage Vs is applied to scan electrodes SC1 through SCn in the discharge cell having abnormal charge, however, discharge can occur. The time period when sustain voltage Vs is applied to scan electrodes SC1 through SCn is set longer than the duration of the sustain pulse in the sustain period. Therefore, the probability that the discharge cells having abnormal charge discharge in the abnormal charge erasing period is extremely higher than that of discharge by the sustain pulse, and most of the discharge cells having abnormal charge can be made to discharge in the abnormal charge erasing period.

Next, while data electrodes D1 through Dm and sustain electrodes SU1 through SUn are kept at 0 (V), negative voltage Va is applied to scan electrodes SC1 through SCn. The discharge cell having abnormal charge discharges again, and the abnormal charge is erased. Therefore, sustain discharge does not occur in the subsequent sustain period.

The driving voltage waveform in the subsequent address period and sustain period is the same as that in FIG. 3, and hence it is not described. In the discharge cell having caused discharge in the abnormal charge erasing period, the wall charge required for the addressing operation is also erased when the abnormal charge is erased, and hence the addressing operation cannot be performed. This state of the wall charge continues until the next all-cell initializing operation is performed.

Next, the driving voltage waveform of the subfield that is a selective initializing subfield and has no abnormal charge erasing period is described with reference to FIG. 5.

In the selective initializing period, voltage Ve1 is applied to sustain electrodes SU1 through SUn and 0 (V) is applied to data electrodes D1 through Dm, a ramp waveform voltage gradually decreasing from voltage Vi3' to voltage Vi4 is applied to scan electrodes SC1 through SCn.

In the discharge cell that has caused the sustain discharge in the sustain period of the last subfield, feeble initializing discharge occurs, and the wall voltage on scan electrode SC1 and sustain electrode SU1 is reduced. Regarding data electrode Dk, sufficient positive wall voltage is accumulated on data electrode Dk by the last sustain discharge, so that the wall voltage is discharged by the excessive amount to be adjusted to be appropriate for the addressing operation.

While, in the discharge cell that has not caused the sustain discharge in the last subfield, discharge is not performed and the wall charge at the completion of the initializing period of the last subfield is kept. In the selective initializing operation, initializing discharge is selectively performed in the discharge cell where a sustain operation is performed in the sustain period of the last subfield.

The operation of the subsequent address period is similar to the operation of the address period of the all-cell initializing subfield, and hence it is not described. The operation of the subsequent sustain period is similar except for the number of sustain pulses.

Next, the driving voltage waveform of the subfield that is a selective initializing subfield and has an abnormal charge erasing period is described with reference to FIG. 6.

The selective initializing operation in the initializing period, the addressing operation in the address period, and the sustain operation in the sustain period are the same as respective operations in the selective initializing subfield having no abnormal charge erasing period, and hence they are not described.

The abnormal charge erasing period is the same as that described using FIG. 4. In other words, while data electrodes D1 through Dm are kept at 0 (V), voltage Vs is applied to scan electrodes SC1 through SCn and 0 (V) is applied to the sustain electrodes. At this time, as discussed above, discharge does not occur in a normal discharge cell. However, the probability that discharge cells having abnormal charge discharges is high, and most of the discharge cells having abnormal charge can be made to discharge in the abnormal charge erasing period.

Then, while data electrodes D1 through Dm and sustain electrodes SU1 through SUn are kept at 0 (V), negative voltage Va is applied to scan electrodes SC1 through SCn. At this time, the discharge cell having abnormal charge discharges again, and the abnormal charge is erased. Therefore, false lighting does not occur in the subsequent sustain period. Since the wall charge required for the addressing operation is erased also when the abnormal charge is erased, and the addressing operation cannot be performed. This state of the wall charge continues until the next all-cell initializing operation is performed.

In the above description, in the abnormal charge erasing period, voltage Vs is applied as rectangular waveform voltage to scan electrodes SC1 through SCn. However, the present invention is not limited to this, and the following voltage is simply required to be applied to scan electrodes SC1 through SCn. At this voltage, there is possibility that the discharge cell having abnormal charge discharges, and there is no possibility that the discharge cell having no abnormal charge discharges. The voltage at which there is no possibility of discharge in the discharge cell having no abnormal charge is rectangular waveform voltage, for example. The voltage at which there is no possibility of discharge in the discharge cell having no abnormal charge is not limited to the rectangular waveform voltage, but the rectangular waveform voltage is taken as an example in the subsequent descriptions and drawings.

Next, the subfield structure of the present embodiment is described. One field is divided into 10 subfields. Each subfield has a greater luminance weight than the previous one. The 10 subfields are called a first SF, second SF, . . . , and 10th SF. The luminance weights of the first SF, second SF, . . . , and 10th SF are set to be 1, 2, 3, 6, 11, 18, 30, 44, 60 and 80, for example.

Figure 7A:
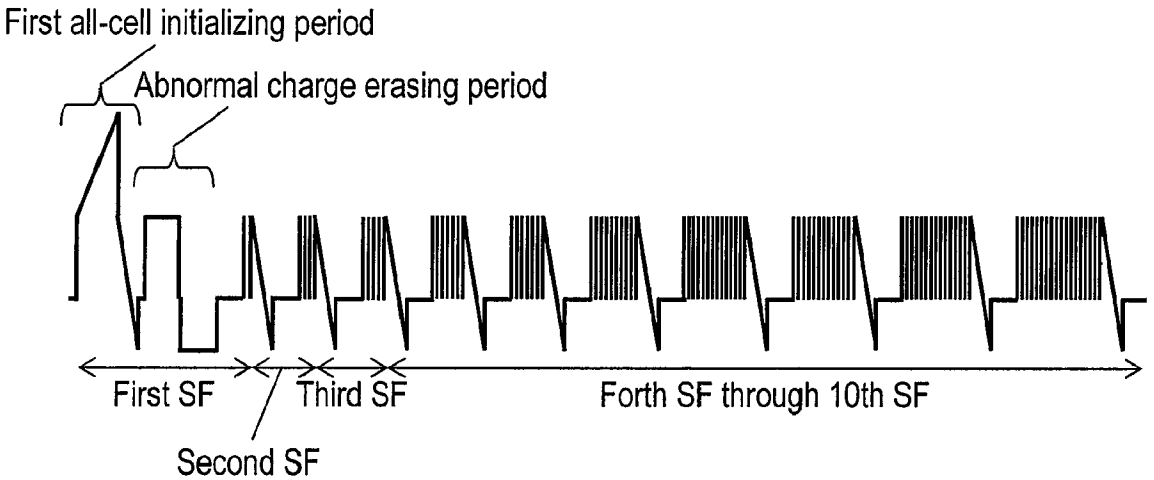
FIG. 7A shows a subfield structure in accordance with the exemplary embodiment.
Figure 7B:
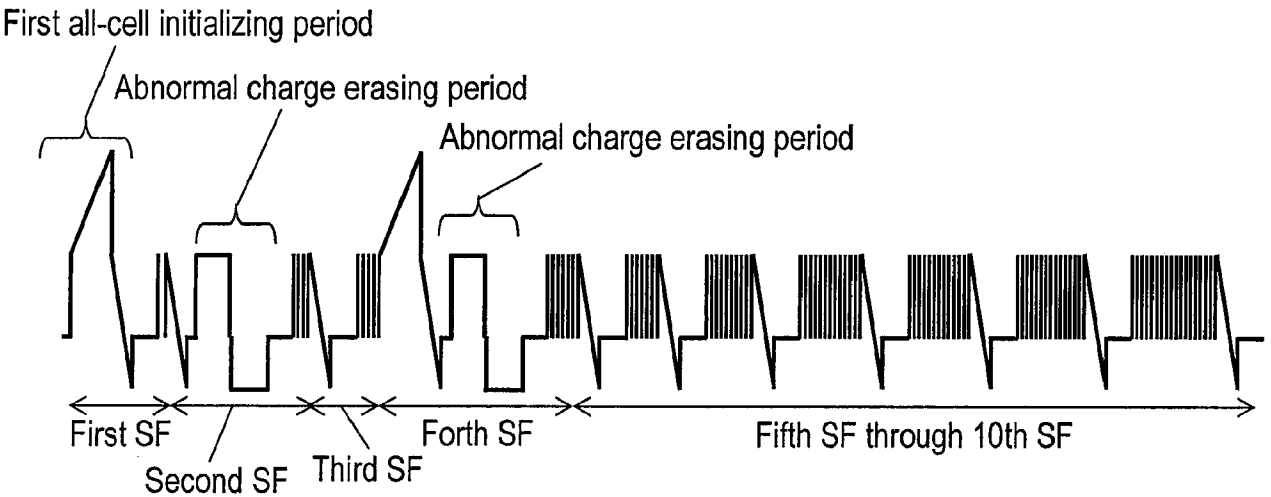
FIG. 7B shows another subfield structure in accordance with the exemplary embodiment.

FIG. 7A and FIG. 7B show subfield structures in accordance with the exemplary embodiment of the present invention. FIG. 7A schematically shows the subfield structure of the field corresponding to the image signal for displaying black on the whole screen, namely the field corresponding to the black display signal. FIG. 7B schematically shows the subfield structure of the field corresponding to an image signal other than the black display signal.

In the field corresponding to the black display signal, as shown in FIG. 7A, the first SF is the first all-cell initializing subfield, and the second SF through 10th SF are selective initializing subfields. An abnormal charge erasing period is disposed after the all-cell initializing period of the first SF, and no abnormal charge erasing period is disposed after the initializing period in the other subfield.

On the other hand, in the field corresponding to the image signal other than the black display signal, as shown in FIG. 7B, the first SF is the first all-cell initializing subfield. No abnormal charge erasing period is disposed after the all-cell initializing period in the first SF, and an abnormal charge erasing period is disposed after the initializing period of the second SF. Additionally, an abnormal charge erasing period is also disposed after the initializing period of the fourth SF, in the present embodiment. However, an abnormal charge erasing period may be disposed after the initializing periods of the second SF through 10th SF as necessary. In the present embodiment, the fourth SF is an all-cell initializing subfield, but is not the first all-cell initializing period of the field. Thus, in the present embodiment, in the field corresponding to the image signal for displaying black on the whole screen, the abnormal charge erasing period when rectangular waveform voltage is applied to the scan electrodes is disposed after the initializing period of the subfield where the all-cell initializing operation is firstly performed. In the field corresponding to an image signal other than the image signal for displaying black on the whole screen, no abnormal charge erasing period is disposed after the subfield where the all-cell initializing operation is firstly performed, and an abnormal charge erasing period is disposed after the initializing period of any later subfield.

FIG. 7A and FIG. 7B schematically show one field of the driving voltage waveform to be applied to the scan electrodes, and the detail is shown by FIG. 3 through FIG. 6.

The reason why the subfield having the abnormal charge erasing period is varied in response to the image signal is described below.

As discussed above, a discharge cell having abnormal charge can accidentally and falsely light up in the sustain period of each subfield. Once the false lighting occurs, sustain discharge due to the false lighting continues until the completion of the sustain period. The light emitted by the false lighting is brighter in a subfield having larger luminance weight, namely in a subfield disposed more backward in the present embodiment. When the discharge cell that is not to light up emits bright light, the image display quality is significantly damaged. Therefore, the light emission luminance due to the abnormal charge must be minimized. For the minimization, preferably, an abnormal charge erasing period is disposed in a subfield disposed as forward as possible after the first all-cell initializing operation of the field, and the abnormal charge is erased.

When the abnormal charge erasing period is disposed after the subfield where the first all-cell initializing operation is performed in the field, however, it becomes clear that the following possibility is raised. When the panel is used in an extremely severe environment such as high temperature or low temperature, a discharge cell discharges in the abnormal charge erasing period though the all-cell initializing operation is performed normally. As discussed above, the discharge cell that has discharged in the abnormal charge erasing period cannot perform addressing operation in the address period of the subsequent subfield. Therefore, when a discharge cell to light up discharges in the abnormal charge erasing period, the discharge cell cannot emit light.

In the present embodiment, in the field corresponding to the image signal other than the black display signal, namely the image signal having the discharge cell that is to light up, an abnormal charge erasing period is not disposed after the initializing period of the first SF as the first all-cell initializing subfield, but an abnormal charge erasing period is disposed after the initializing periods of the subsequent second SF and fourth SF.

While, in the field corresponding to the black display signal, each discharge cell displays "black" and is apt to cause abnormal initializing discharge. Therefore, it is preferable that the abnormal charge is erased by disposing an abnormal charge erasing period in a subfield disposed as forward as possible after the all-cell initializing operation. In the present embodiment, an abnormal charge erasing period is disposed after the all-cell initializing period of the first SF.

Figure 8:
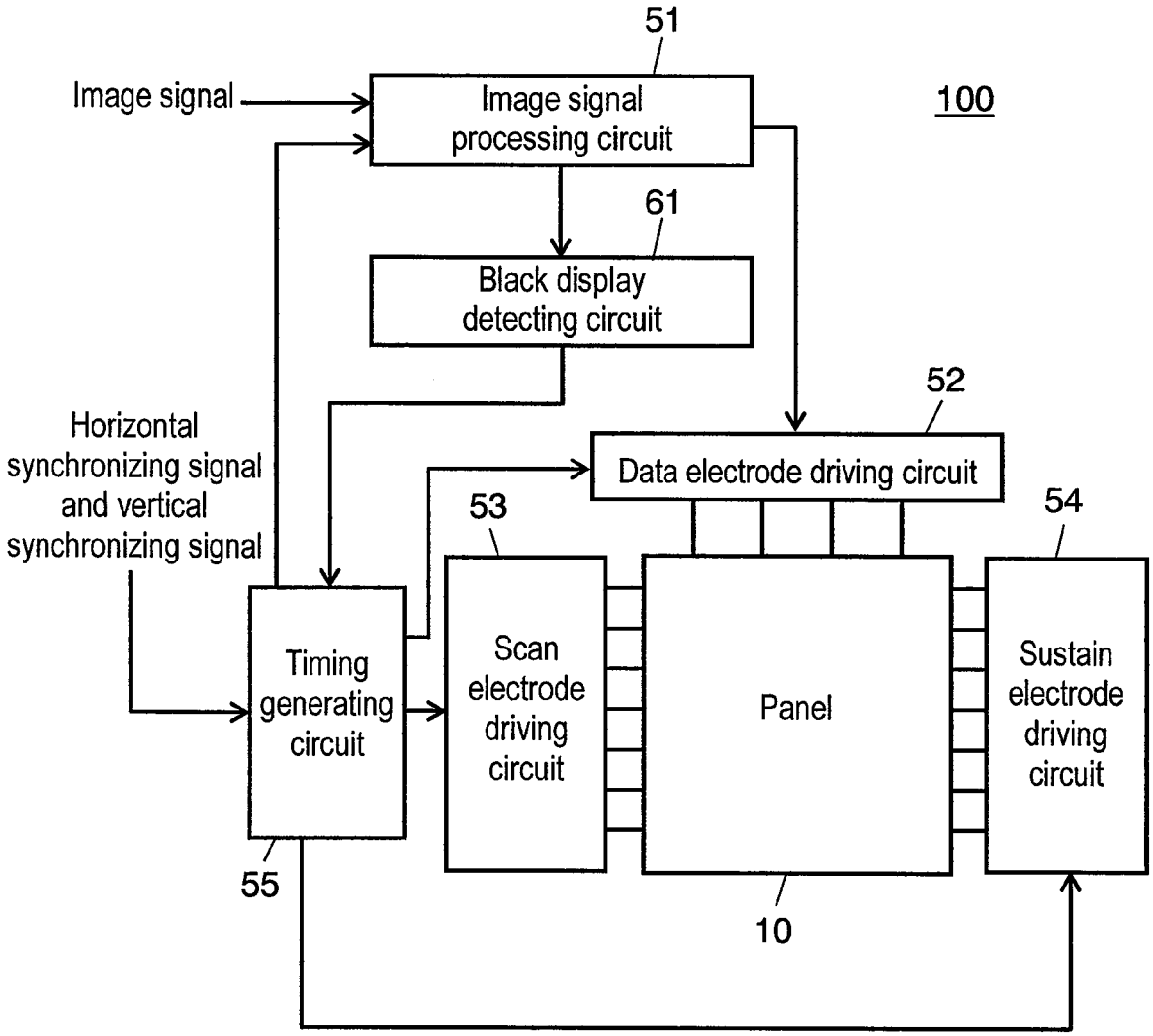
FIG. 8 is a circuit block diagram of a plasma display device in accordance with the exemplary embodiment.

Next, the circuitry of the plasma display device of the present embodiment of the present invention is described. FIG. 8 is a circuit block diagram of plasma display device 100 of the present embodiment of the present invention.

Plasma display device 100 has the following elements:

panel 10;

image signal processing circuit 51;

data electrode driving circuit 52;

scan electrode driving circuit 53;

sustain electrode driving circuit 54;

timing generating circuit 55;

black display detecting circuit 61; and a power supply circuit (not shown) for supplying power required for each circuit block.

Here, data electrode driving circuit 52, scan electrode driving circuit 53, sustain electrode driving circuit 54, timing generating circuit 55, and black display detecting circuit 61 are collectively called a driving circuit.

Image signal processing circuit 51 converts an input image signal into image data that indicates emission or non-emission of light every subfield. Data electrode driving circuit 52 converts the image data every subfield into a signal corresponding to each of data electrodes D1 through Dm, and drives each of data electrodes D1 through Dm.

Black display detecting circuit 61 calculates lighting ratio of the discharge cell of each subfield, namely ratio of discharge cells for performing sustain discharge in the subfield to all discharge cells, based on image data. An image signal where the lighting ratio of all subfields is "0" is detected as an image signal for displaying black on the whole screen, namely a black display signal.

Timing generating circuit 55 generates various timing signals for controlling operation of each circuit block based on a horizontal synchronizing signal, a vertical synchronizing signal, and a detection output of black display detecting circuit 61, and supplies them to respective circuit blocks. Timing generating circuit 55 generates a timing signal so that two following fields have different subfield structures as shown in FIG. 7A and FIG. 7B. Here, one field corresponds to the image signal from which black display detecting circuit 61 has detected the black display signal. Another field corresponds to the image signal from which black display detecting circuit 61 has not detected the black display signal. Scan electrode driving circuit 53 generates a scan electrode driving voltage waveform based on the timing signal, and drives each of scan electrodes SC1 through SCn. Sustain electrode driving circuit 54 also generates a sustain electrode driving voltage waveform based on the timing signal, and drives sustain electrodes SU1 through SUn.

Figure 9:
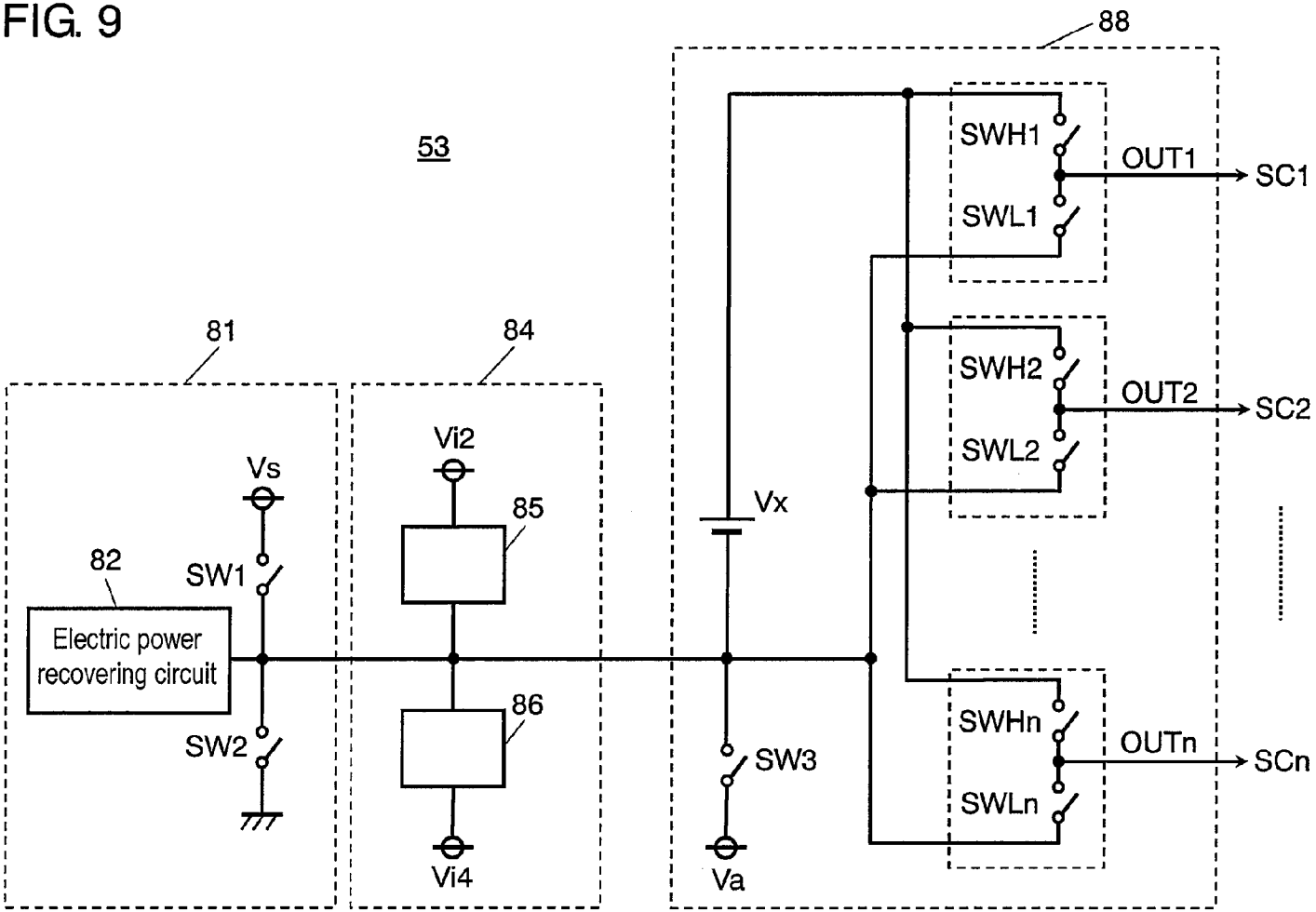
FIG. 9 is a circuit diagram of a scan electrode driving circuit of the plasma display device.

Next, a method of generating a voltage waveform for erasing abnormal charge in the abnormal charge erasing period is described. FIG. 9 is a circuit diagram of scan electrode driving circuit 53 of plasma display device 100 in accordance with the exemplary embodiment of the present invention.

Scan electrode driving circuit 53 has the following elements:

sustain pulse generating circuit 81 for generating a sustain pulse;

initializing waveform generating circuit 84 for generating an initializing waveform; and scan pulse generating circuit 88 for generating a scan pulse.

Sustain pulse generating circuit 81 has the following elements:

electric power recovering circuit 82 for recovering and reusing electric power when scan electrodes SC1 through SCn are driven;

switching element SW1 for clamping scan electrodes SC1 through SCn to voltage Vs; and switching element SW2 for clamping scan electrodes SC1 through SCn to 0 (V).

Initializing waveform generating circuit 84 has the following elements:

a Miller integrating circuit 85 for generating a ramp waveform voltage that gradually increases to voltage Vi2 in the initializing period; and a Miller integrating circuit 86 for generating a ramp waveform voltage that gradually decreases to voltage Vi4.

Scan pulse generating circuit 88 has the following elements:

power supply VX for generating voltage Vc in the address period;

switching element SW3 for clamping the low voltage side of the power supply to voltage Va; and switching units OUT1 through OUTn for outputting scan pulses to be applied to scan electrodes SC1 through SCn.

Switching units OUT1 through OUTn have switching elements SWH1 through SWHn for outputting voltage Vc, and switching elements SWL1 through SWLn for outputting voltage Va.

Figure 10:
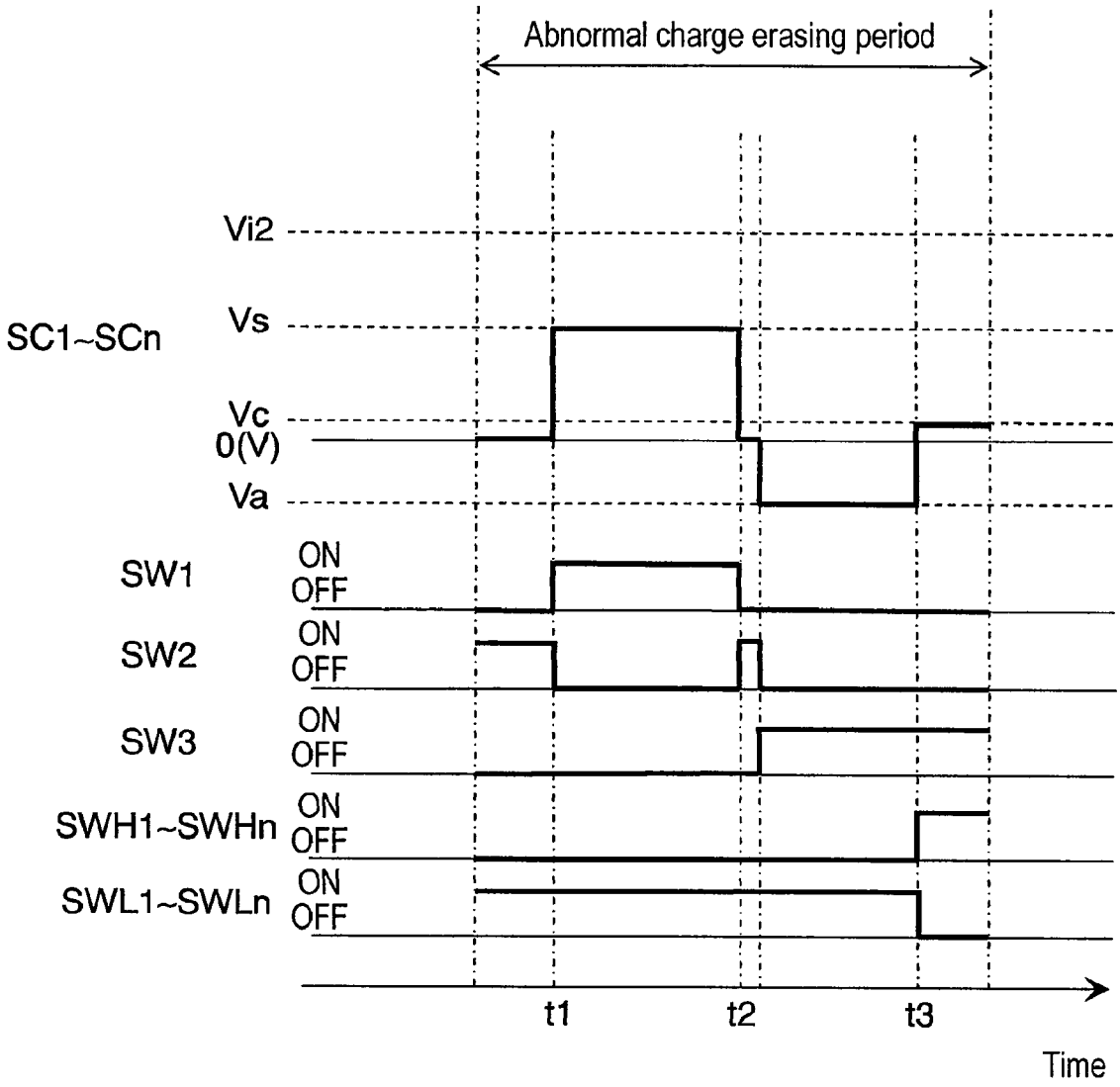
FIG. 10 is a detailed waveform chart of voltage applied to a scan electrode in an abnormal charge erasing period in accordance with the exemplary embodiment.

Next, operation of scan electrode driving circuit 53 is described. FIG. 10 is a detailed waveform chart of voltage applied to scan electrodes SC1 through SCn in the abnormal charge erasing period in accordance with the exemplary embodiment of the present invention. In the following description, the operation of conducting each switching element is denoted with ON, and the operation of breaking it is denoted with OFF.

First, 0 (V) is applied to scan electrodes SC1 through SCn. Switching element SW2 of sustain pulse generating circuit 81 and switching elements SWL1 through SWLn of switching units OUT1 through OUTn are set at ON, and the other switching elements are set at OFF.

At time t1, switching element SW2 of sustain pulse generating circuit 81 comes into the OFF state, and switching element SW1 comes into the ON state. At this time, voltage Vs is applied to scan electrodes SC1 through SCn via switching element SW1 and switching elements SWL1 through SWLn.

At time t2, switching element SW1 of sustain pulse generating circuit 81 comes into the OFF state, switching element SW2 comes into the ON state, and scan electrodes SC1 through SCn are temporarily returned to 0 (V). Then, switching element SW2 of sustain pulse generating circuit 81 comes into the OFF state, switching element SW3 of scan pulse generating circuit 88 comes into the ON state. Voltage Va is applied to scan electrodes SC1 through SCn via switching element SW2 and switching elements SWL1 through SWLn.

At time t3, switching elements SWL1 through SWLn of switching units OUT1 through OUTn come into the OFF state, switching elements SWH1 through SWHn come into the ON state, and voltage Vc is applied to scan electrodes SC1 through SCn. The period after t3 is the address period.

In the present embodiment, the period from time t1 to time t2 is set at 6 μsec. However, preferably, this period is set between 3 μsec and 30 μsec. In the present embodiment, the period from time t2 to time t3 is set at 2.5 μsec. However, preferably, this period is set between 1 μsec and 10 μsec.

In the present embodiment, in the field corresponding to an image signal other than the image signal for displaying black on the whole screen, an abnormal charge erasing period is disposed in the second SF and fourth SF. However, the present invention is not limited to this. An abnormal charge erasing period may be disposed in any subfield after the subfield where the all-cell initializing operation is firstly performed, In the present embodiment, the number of subfields and the luminance weight of each subfield are not limited to the above-mentioned values, but other subfield structure may be employed.

Each specific numerical value used in the present embodiment is an example. Preferably, an optimum value is employed appropriately in response to the characteristic of the panel or the specification or the like of the plasma display device.

As a result, the present invention can provide a panel driving method and a plasma display device that do not cause false lighting even if the all-cell initializing operation becomes unstable, and do not significantly reduce the image display quality.

INDUSTRIAL APPLICABILITY

The present invention can provide a panel driving method that does not cause false lighting and does not significantly reduce the image display quality. Therefore, present invention is useful as a panel driving method and plasma display device.

The invention claimed is:

1. A driving method of a plasma display panel having a plurality of discharge cells including a display electrode pair, the display electrode pair being formed of a scan electrode and a sustain electrode, the driving method comprising:

providing one field with a plurality of subfields, each of the subfields having an initializing period, and address period, and a sustain period;

performing an all-cell initializing operation of causing initializing discharge in all discharge cells or a selective initializing operation of causing initializing discharge in a discharge cell that has caused sustain discharge in just previous sustain period, in the initializing period of each of the subfields; and providing an abnormal charge erasing period for applying voltage to the scan electrode in a subfield selected based on an image signal, wherein the abnormal charge erasing period is provided only in a selected first subfield after the all-cell initializing operation is performed, when the image signal indicates displaying a black image, wherein the abnormal charge erasing period is provided in at least one other selected subfield after the selected first subfield, when the image signal indicates displaying a non-black image.

2. The driving method of the plasma display panel of claim 1, wherein voltage applied in the abnormal charge erasing period is rectangular waveform voltage.

3. The driving method of the plasma display panel of claim 1, further comprising:

providing an abnormal charge erasing period for applying rectangular waveform voltage to the scan electrode after the initializing period in a subfield next to the subfield where the all-cell initializing operation is firstly performed, in a field indicated by the image signal as displaying the non-black image.

4. The driving method of the plasma display panel of claim 1, further comprising:

providing an abnormal charge erasing period for applying rectangular waveform voltage to the scan electrode after the initializing periods in a plurality of subfields, in a field indicated by the image signal as displaying the non-black image.

5. A plasma display device comprising:

a plasma display panel having a plurality of discharge cells including a display electrode pair, the display electrode pair being formed of a scan electrode and a sustain electrode; and a driving circuit for providing one field period with a plurality of subfields and driving the plasma display panel, each of the subfields including:

an initializing period for causing initializing discharge in the discharge cell;

an address period for performing an addressing operation in the discharge cell; and a sustain period for causing sustain discharge in the discharge cell where address discharge is caused by the addressing operation, wherein the driving circuit performs an all-cell initializing operation of causing initializing operation, in all discharge cells for performing image display in the initializing period of at least one subfield, and wherein the driving circuit provides an abnormal charge erasing period for applying voltage to the scan electrode in a subfield selected based on an image signal so that:

the driving circuit applies voltage for easing abnormal charge to the scan electrode only in a selected first subfield where after the all-cell initializing operation is firstly performed , when the image signal indicates displaying a black image, and the driving circuit applies voltage for erasing abnormal charge to the scan electrode in at least one other selected subfield after the selected first subfield, when the image signal indicates displaying a non-black image.

6. The plasma display device of claim 5, wherein the voltage for erasing abnormal charge is rectangular waveform voltage.

7. The driving method of the plasma display panel of claim 2, further comprising:

providing an abnormal charge erasing period for applying rectangular waveform voltage to the scan electrode after the initializing period in a subfield next to the subfield where the all-cell initializing operation is firstly performed, in a field indicated by the image signal as displaying the non-black image.

8. The driving method of the plasma display panel of claim 2, further comprising:

providing an abnormal charge erasing period for applying rectangular waveform voltage to the scan electrode after the initializing periods in a plurality of subfields, in a field indicated by the image signal as displaying the non-black image.

* * * * *